United States Patent [19]

Hickory et al.

[11] Patent Number: 5,061,295

[45] Date of Patent: Oct. 29, 1991

[54] GRINDING WHEEL ABRASIVE COMPOSITION

[75] Inventors: Gordon E. Hickory, Rutland, Mass.; Michael J. White, Cumberland, R.I.

[73] Assignee: Norton Company, Worcester, Mass.

[21] Appl. No.: 601,632

[22] Filed: Oct. 22, 1990

[51] Int. Cl.[5] ..... C09K 3/14

[52] U.S. Cl. ..... 51/298; 51/297; 51/308

[58] Field of Search ..... 51/297, 298, 308

[56] References Cited

U.S. PATENT DOCUMENTS

| | | | |
|---|---|---|---|
| 3,030,198 | 4/1962 | Kibbey | 51/298 |
| 3,246,970 | 4/1966 | Zimmerman | 51/298 |
| 4,263,016 | 4/1981 | Hirschberg et al. | 51/298 |
| 4,381,925 | 5/1983 | Colleselli | 51/298 |

*Primary Examiner*—William R. Dixon, Jr.
*Assistant Examiner*—Sue Hollenbeck
*Attorney, Agent, or Firm*—Arthur Loiselle, Jr.

[57] ABSTRACT

An improved abrasive product such as a grinding wheel is disclosed. The abrasive product contains an active filler mixture of tin, $FeS_2$, and $K_2SO_4$, which mixture improves the grinding quality and versatility of the abrasive product.

10 Claims, No Drawings

GRINDING WHEEL ABRASIVE COMPOSITION

TECHNICAL FIELD

The present invention is directed to a resin bonded abrasive material, particularly a phenolic resin bonded abrasive material containing active fillers which material is useful in forming an abrasive product such as a grinding wheel.

BACKGROUND OF THE INVENTION

It is known that grinding aids of various types may be used to improve the cutting efficiency of resin bonded abrasive grain in grinding wheels and coated abrasives. Various combinations of abrasive grain and active filler materials supported in a resin bond have been suggested for improving grinding action of abrasive products and certain combinations have been found to be especially useful for grinding and/or cutting ferrous materials. It is known that the grinding performance of resin bonded grinding wheels can be significantly improved when active fillers are employed. A good active filler can help remove metal more efficiently and reduce the amount of heat generated in the grinding process which results in a decrease in required grinding energy and an increase in grinding wheel life.

Resin bonded grinding wheels including combinations of alumina and other abrasive grains with finely divided fillers such as cryolite, pyrite or $FeS_2$, $KAlF_4$, $K_3AlF_6$, $K_2SO_4$,$PbCl_2$, PbO, $Sb_2S_3$ and mixtures of these materials are known and used commercially. It has been found that certain combinations of fillers provide superior grinding quality when used in mixtures. For example, a mixture of $FeS_2$ and $K_2SO_4$ produces a synergistic effect when used in a phenolic bonded cut-off wheel with an alumina abrasive. While grinding wheels containing a mixture of $FeS_2$ and $K_2SO_4$ generally perform better than other prior art grinding wheels for many applications, the $FeS_2/K_2SO_4$ wheel is relatively hard acting and burns the workpiece severly at moderate to low cutting rates. A grinding wheel which overcomes these problems is thus needed.

U.S. Pat. No. 4,475,926 disclosures a resinoid bonded abrasive article in which the resinoid bond includes 5–80% by volume of an improved active filler. The active filler is a mixture of iron pyrites, potassium sulfate, and an alkali haloferrate. In column 1, the patent discloses examples of various known fillers used in grinding wheel formations.

U.S. Pat. No. 2,258,774 discloses an organic bonded abrasive material containing certain low melting point metals such as lead, tin, bismuth, antimony, cadmium or alloys thereof. The metals are taught as being lubricants for the abrasive material.

DISCLOSURE OF THE INVENTION

It has now been found that a combination of tin, $FeS_2$ and $K_2SO_4$ in a resin bonded abrasive grinding wheel results in an improvement in grinding efficiency and quality in relation to prior art materials, particularly those containing only a combination of $FeS_2$ and $K_2SO_4$ as active fillers. The active fillers are generally present in an amount of up to about 40% by volume of final abrasive product.

DETAILED DESCRIPTION OF THE PREFERRED EMBODIMENTS

The resin bonded abrasive articles of the presen invention generally comprise a polymeric bonding material such as an organic polymer, an abrasive, and ar active filler system comprising a synergistic combination of tin, $FeS_2$ and $K_2SO_4$. The article may also contain conventional mixing aids such as liquid plasticizers Any suitable polymeric bonding material may bc used, including simple and modified phenol-formaldehyde resins, epoxy resins, polyester resins, shellac, polyimide, and rubber. It is presently preferred to employ a phenolic resin. The organic polymer is generally present in an amount of from about 15% to 40%, more preferably in an amount of from about 18 to 30%, anc most preferably from about 20 to 25%, by volume. It is important that the organic polymer content not be sc low that the resulting abrasive product lacks sufficien strength for safe use.

The abrasive material which may be employed includes fused alumina, sintered alumina including such as those described in U.S. Pat. Nos. 4,314,827 anc 4,623,364, silicon carbide, garnet, flint, fused alumina zirconia, diamond, and mixtures thereof. Other suitable abrasives may also be used. The abrasive is generally present in an amount of from about 30 to 60%, more preferably in an amount of from about 35 to 55%, anc most preferably in an amount of from about 40 to 50% by volume.

The active filler system comprises a mixture of Sn (tin), $FeS_2$, and $K_2SO_4$. The total filler system is presen in an amount of at least about 5 volume %, generally from about 5 to 40%, more preferably of from about 1( to 30%, and most preferably of from about 15 to 25% by volume. The tin portion of the filler system may range from about 2 to 20 volume % of the abrasive article though more preferably it is used in an amount o from about 3 to 10%. The $FeS_2$ is generally present in an amount of from about 2.5 to 10% and more preferably in an amount of from about 4 to 9%. The $K_2SO$ component of the system generally ranges from abou 2.5 to 10% by volume of the abrasive article and more preferably of about 4 to 9%. Generally, the three components of the active filler system are used in ratios o tin:$FeS_2$:$K_2SO_4$ ranging from about 80:10:10 t 10:45:45.

Conventional mixing aids which may be used include liquid plasticizers such as tri-decylalcohol, chlorinatec paraffins, and furfural. They are generally present in a amount of from about 1 to 10% by volume of the tota composition, preferably from about 2 to 6%. Any othe ingredients conventionally incorporated into resin bonded abrasive products may also be incorporated int the products of this invention.

The abrasive articles will also contain porosity, gen erally up to about 15 volume %, preferably about 1–1 volume 5, and most preferably about 3–8 volume %.

An example of a preferred abrasive article accordin to the present invention contains about 45.6% abrasive about 22.6% organic polymer; about 4.6% liquid plasti cizers; and a filler system containing about 8.6% FeS about 8.6% $K_2SO_4$, about 4.0% tin, and about 6% pc rosity.

The abrasive article of the present invention may b manufactured by any suitable process, although it i presently preferred to proceed as set forth hereinbelow The organic polymer which is preferably a phenoli resin is used in both liquid and powder forms. The liquid resin is mixed with the tin and the abrasive while the dry powder resin is separately mixed with the other two components of the filler system. Then, the two mixtures are combined along with any liquid plasticizers or other ingredients by conventional means.

To form an abrasive article such as a grinding wheel, the resulting mixture is measured into a mold set up for pressing a cut off wheel, e.g. a steel mold approximately 16"×1/8"×1" used at about 800 tons of total force. The pressed wheel shape is then cured in an oven at a temperature of about 175° C. following conventional known resinoid bonded wheel manufacturing procedures.

In the following non-limiting examples, all parts and percents are by volume unless otherwise specified.

EXAMPLE I

A 16"×1/8"×1" cut-off wheel of the present invention is prepared from 48.2% of a 50:50 mixture of 24 and 30 grit alumina particles as the abrasive; 5.9% liquid phenolic resin; 17.9% powdered phenolic novolac resin; 3.8% of a liquid plasticizer mixture of tridecyl alcohol, chlorinated paraffin, and furfural; and 18.1% active filler mixture of $Sn:FeS_2:K_2SO_4$ in a 2:1:1 ratio, i.e. about 9% tin and 4.5% each of $FeS_2$ and $K_2SO_4$, and 6.2% porosity. The tin is added to the alumina particles after they are mixed with the liquid resin and before a mixture of the other dry components are added. The mixture is measured into a steel mold of the appropriate size, subjected to about 800 tons total force, and then cured in an oven at 175° C. in a conventional manner for 34 hours. The wheel is referred to as Wheel I below.

COMPARATIVE EXAMPLE A

The basic procedure of Example I was repeated on a slightly different abrasive formulation with the primary change being the omission of the tin. The wheel contained 48.4% alumina, 5.4% liquid phenolic resin, 18.5% powdered phenolic resin, 3.5% plasticizer mixture, 18.2% active filler mixture, and 6% porosity. The $FeS_2$ and the $K_2SO_4$ were each used in an amount of 9.1%. The wheel is referred to as Wheel A below.

COMPARATIVE EXAMPLE B

The basic procedure of Example I was repeated except that the $FeS_2$ and the $K_2SO_4$ were omitted from the formulation. The specific wheel contained 48.1% alumina, 5.9% liquid phenolic resin, 17.8% powdered phenolic resin, 4.1% plasticizer mixture, 18.1% tin, and 6% porosity. The wheel is referred to as Wheel B below.

EXAMPLE II

A variation of the procedure of Example I is used to produce another wheel containing the three active fillers, but having a reduced level of tin concentrated at the interface between the abrasive and the bond. To accomplish this, the tin (4%) is coated onto 45.6% alumina particles by first mixing the alumina particles with the liquid phenolic resin and then mixing in the tin to form a homogenous mix. The tin-coated abrasive is then processed as in Example I along with 22.5% total phenolic resin, 4.6% of the liquid plasticizer mixture, and 8.6% of each of the $FeS_2$ and the $K_2SO_4$. The total active filler content is increased to 21.2% but the level of tin is reduced to 4%. The wheel which contains 6% porosity is referred to as Wheel II below.

EXAMPLE III

The four wheels produced above are used for cutting metal and for this purpose are mounted on a Stone M150 hydraulic cut-off machine and are tested cutting 1.5" diameter C1018 cold rolled steel bars. Thirty test runs are made at each of 2.5, 3.5, and 4.5 seconds to complete the cut through the bar at a wheel speed of 12,000 sfpm. The results are shown in Table I wherein MRR is the metal removal rate in cubic inches per minute, E is the grinding power in kilowatts, G-Ratio is the ratio of volume of metal removed to volume of wheel worn away, E/MRR is the specific grinding energy, and % Burn is the percent workpiece that is burned:

TABLE I

Cut-Off Grinding Results on 1.5" Diam. C1018 Steel

| Wheel | Time/Cut | MRR | E | G-Ratio | E/MRR | % Burn |
|---|---|---|---|---|---|---|
| I | 2.5 | 5.62 | 12.43 | 5.03 | 2.21 | 0 |
| | 3.5 | 4.00 | 9.89 | 6.66 | 2.48 | 20 |
| | 4.5 | 3.14 | 9.41 | 6.33 | 3.00 | 50 |
| A | 2.5 | 5.66 | 13.61 | 6.29 | 2.40 | 0 |
| | 3.5 | 4.02 | 12.14 | 6.47 | 3.03 | 70 |
| | 4.5 | 3.12 | 11.76 | 4.03 | 3.76 | 100 |
| B | 2.5 | 5.70 | 12.38 | 3.96 | 2.17 | 0 |
| | 3.5 | 4.09 | 9.50 | 5.13 | 2.32 | 0 |
| | 4.5 | 3.20 | 8.65 | 5.79 | 2.70 | 45 |
| II | 2.5 | 5.56 | 12.53 | 5.25 | 2.26 | 0 |
| | 3.5 | 3.92 | 9.51 | 6.29 | 2.42 | 30 |
| | 4.5 | 3.08 | 9.01 | 5.79 | 2.70 | 60 |

The results in Table I demonstrate that the addition of tin as a co-active filler in Wheels I and II to a mixture of $FeS_2$ and $K_2SO_4$ produces an improved grinding wheel, particularly at moderate to low cutting rates.

Wheel A with the $FeS_2$ and $K_2SO_4$ mixture is hard acting, burning the workpiece severely at both moderate and low cutting rates.

And when the $FeS_2$ and $K_2SO_4$ mixture in Wheel A is replaced by tin as in Wheel B, the wheel becomes very soft, is much freer cutting, and only burns the workpiece slightly at the lowest cut-rate. The versatility of the tin-filled phenolic wheel is obviously much greater than the mixture of $FeS_2$ and $K_2SO_4$, but this occurs at a major loss in wheel life and a high wheel manufacturing cost due to the presence of 18 volume % tin in the wheel. Tin has a very high density (7.3 g/cc) and is a costly (currently $6.50/lb.) material.

However, when tin is used in combination with the $FeS_2$ and $K_2SO_4$ as in Wheel I, there is an increased wheel life compared to Wheel B (tin only) as well as a general improvement in versatility and grinding quality over Wheel A (no tin). And when the amount of tin is reduced to only 4% in Wheel II to reduce the cost of the wheel and much of the tin is placed at the interface between the abrasive and the bond, a lower wheel cost is achieved at essentially no difference in performance. A comparison of the performances of Wheels I and II shows little difference even though I has 9% tin and II only 4%.

EXAMPLE IV

The procedure of Example I was repeated to produce three different wheels. Wheel IV was made as in Example I. Wheel A was made as in Comparative Example A with a mixture of $FeS_2$ and $K_2SO_4$. Wheel A-2 was made of the same composition as A but was oven cured at a temperature of only 160° C. to produce a softer grinding grade version of the prior art wheel. The results of sixty cuts at each cutting rate are shown in Table II.

TABLE II

Cut-Off Grinding Results on 1.5" Diam. C1018 Steel

| Wheel | Time/Cut | MRR | E | G-Ratio | E/MRR | % Burn |
|---|---|---|---|---|---|---|
| IV | 2.5 | 5.47 | 12.12 | 3.12 | 2.21 | 0 |
| | 3.5 | 3.97 | 9.93 | 4.35 | 2.50 | 0 |
| | 4.5 | 3.02 | 8.80 | 4.70 | 2.87 | 50 |
| A | 2.5 | 5.43 | 12.36 | 4.18 | 2.28 | 0 |
| | 3.5 | 3.91 | 12.17 | 4.50 | 3.11 | 75 |
| | 4.5 | | (not tested - burn too heavy) | | | |
| A-2 | 2.5 | 5.60 | 12.41 | 3.08 | 2.22 | 0 |
| | 3.5 | 4.03 | 9.26 | 3.98 | 2.30 | 0 |
| | 4.5 | 3.02 | 9.41 | 3.85 | 3.12 | 65 |

Table II shows that Wheel IV of this invention performs with equal durability (G-ratio) at high cut rate as the softer version of Wheel A, i.e. Wheel A-2, but that at lower cut-rates it is substantially freer cutting and as a result achieves significantly higher wheel life and also a lower level of burn.

The preferred form of this invention has been described above. It is possible that modifications thereof may occur to those skilled in the art which will fall within the scope of the following claims.

What is claimed is:

1. An abrasive product comprising an abrasive material, active fillers, and an organic polymer for bonding the abrasive and the active fillers together to form the abrasive product, the active fillers comprising a combination of tin, $FeS_2$, and $K_2SO_4$ wherein the volume ratio of tin:$FeS_2$:$K_2SO_4$ is from about 10:45:45 to about 80:10:10 and the active fillers are present in an amount of from about 5 to 40% by volume of the abrasive product.

2. The abrasive product of claim 1, wherein the active fillers are present in an amount of from about 10 to about 30% by volume of the abrasive product.

3. The abrasive product of claim 1, wherein the tin is present in an amount of from about 2 to about 20% by volume of the abrasive product.

4. The abrasive product of claim 1, wherein the organic polymer comprises a phenolic resin.

5. The abrasive product of claim 1, wherein the abrasive is selected from the group consisting of fused alumina, sintered alumina, silicon carbide, garnet, flint, fused alumina-zirconia, diamond, and mixtures thereof.

6. The abrasive product of claim 1, wherein the abrasive comprises alumina.

7. The abrasive product of claim 1, wherein the tin is coated on the surface of the abrasive.

8. The abrasive product of claim 1, wherein the abrasive product is a grinding wheel.

9. The abrasive product of claim 1, wherein the abrasive product is a coated abrasive product.

10. The abrasive product of claim 1 further containing a liquid plasticizer.

* * * * *